US008925283B2

(12) United States Patent
Lemieux

(10) Patent No.: US 8,925,283 B2
(45) Date of Patent: Jan. 6, 2015

(54) MODULAR HOUSE BUILDING SYSTEM

(76) Inventor: Luc Lemieux, Chicoutimi (CA)

( * ) Notice: Subject to any disclaimer, the term of this patent is extended or adjusted under 35 U.S.C. 154(b) by 0 days.

(21) Appl. No.: 13/607,738

(22) Filed: Sep. 9, 2012

(65) Prior Publication Data

US 2013/0055654 A1 Mar. 7, 2013

Related U.S. Application Data

(63) Continuation-in-part of application No. 12/951,023, filed on Nov. 20, 2010, now abandoned.

(30) Foreign Application Priority Data

Dec. 18, 2009 (GB) ..... 0922138.3

(51) Int. Cl.
*E04B 1/00* (2006.01)
*E04B 1/10* (2006.01)
*E04B 5/12* (2006.01)

(52) U.S. Cl.
CPC .... *E04B 1/10* (2013.01); *E04B 5/12* (2013.01)
USPC ..... 52/745.1; 52/79.9; 52/272

(58) Field of Classification Search
USPC ..... 52/79.1, 79.9, 264, 265, 270, 272, 283, 52/745.1, 745.05, 745.13
See application file for complete search history.

(56) References Cited

U.S. PATENT DOCUMENTS

| | | | | |
|---|---|---|---|---|
| 788,445 | A | 4/1905 | White | |
| 1,372,206 | A | 3/1921 | Stadelman | |
| 1,689,642 | A | 10/1928 | Rappleyea | |
| 2,281,402 | A | 4/1942 | Wilson, Jr. et al. | |
| 3,674,064 | A | 7/1972 | McRae | |
| 3,813,832 | A | 6/1974 | Caplan et al. | |
| 4,269,006 | A | 5/1981 | Larrow | |
| 6,003,280 | A | 12/1999 | Wells | |
| 6,195,950 | B1 | 3/2001 | Harris | |
| 6,385,937 | B1 | 5/2002 | Alexandre | |
| 6,438,903 | B1 | 8/2002 | Weiss | |
| 7,836,655 | B2 * | 11/2010 | Chen et al. | 52/592.1 |
| 8,448,406 | B2 * | 5/2013 | Shepard | 52/745.2 |

FOREIGN PATENT DOCUMENTS

| | | |
|---|---|---|
| CA | 2582402 | 4/2006 |

* cited by examiner

*Primary Examiner* — William Gilbert
*Assistant Examiner* — Gisele Ford

(57) ABSTRACT

A modular house building system has floor module supports; floor modules; wall modules; window panel modules; door panel modules; and fasteners, wherein the modules are connected to one another in any of a number of configurations using the fasteners to form a chosen modular house configuration; wherein the wall, window panel, and door panel modules each include horizontal planks, vertical planks that define an outer perimeter of each the module, and interstitial planks connected between the vertical planks that are used to increase the strength of each the module, and are connected together in any one of a plurality of configurations to form each respective module in a pre-chosen dimension and configuration.

10 Claims, 10 Drawing Sheets

14
14'
14"
14'''
16
16
20

24

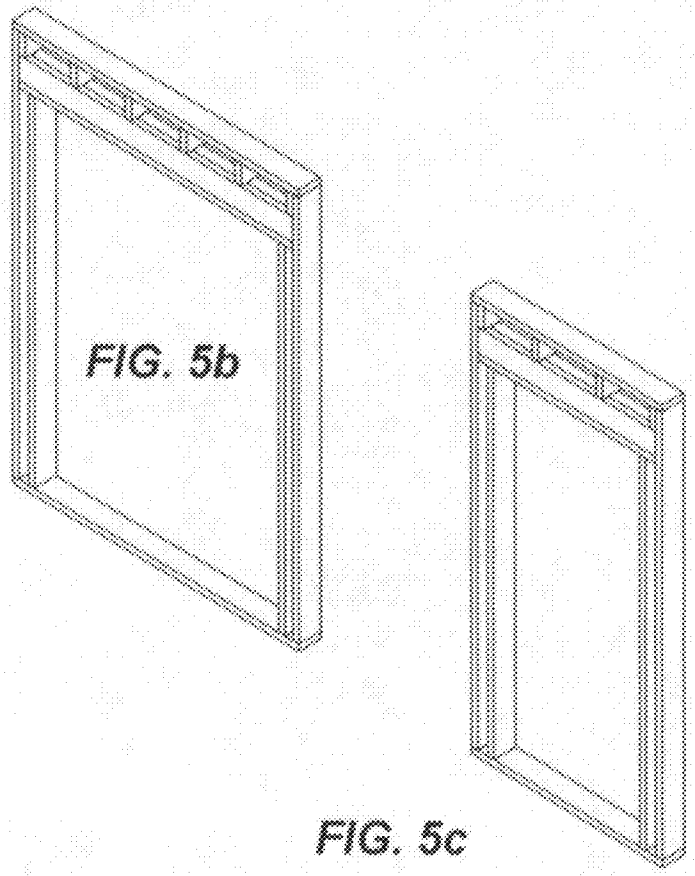
FIG. 5c
FIG. 5b
20
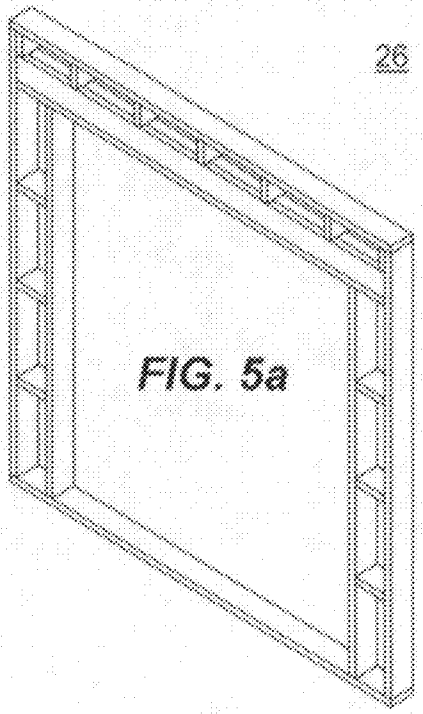
FIG. 5a

MODULAR HOUSE BUILDING SYSTEM

This CIP application claims priority based on application Ser. No. 12/951,023 filed Nov. 20, 2010 now abandoned and which claims priority based on request GB0922138.3 filed Dec. 18, 2009

FIELD OF THE INVENTION

The present invention relates generally to construction but more particularly to a system for building modular houses.

BACKGROUND OF THE INVENTION

There exists many types of modular systems for construction so as to accelerate on site assembly of a structure. From the simplest home all the way to skyscrapers.

SUMMARY OF THE INVENTION

In view of the foregoing disadvantages inherent in the known devices now present in the prior art, the present invention, which will be described subsequently in greater detail, is to provide objects and advantages which are:

To provide for a modular house building system comprising a plurality of floor support modules; floor panels; wall modules; window panel modules; door panel modules; and fasteners, wherein the modules are connected to one another in any of a number of configurations using the fasteners to form a chosen modular house configuration; wherein the wall, window panel, and door panel modules each include horizontal planks, vertical planks that define an outer perimeter of each the module, and interstitial planks connected between the vertical planks that are used to increase the strength of each the module, and are connected together in any one of a plurality of configurations to form each respective module in a pre chosen dimension and configuration.

The modular house building system has the fasteners as mechanical fasteners and are chosen from a group of mechanical fasteners including nails, bolts, and screws.

The modular house building system has the fasteners formed from an adhesive material.

The modular house building system has a method of building a modular house comprising the steps of:

a.) forming a plurality of floor support modules each consisting of a triad of open trusses that are equal in length and, parallel to one another, and kept at a relative distance from one another by way of holding members connected therebetween at predetermined separated intervals, and wherein each of the floor support module has two opposite ends formed from flat pieces of wood having notches formed therein configured and sized to allow for the passage of overlapping planks; and a plurality of overlapping planks each adapted to be fit within respective notches of adjacent floor support modules, such that a plurality of floor support modules can be connected end-to-end via the overlapping planks to form a desired length of floor support modules, and then the floor support modules can be placed side-by-side to form a floor support surface of desired dimensions for supporting the floor panels thereon;

b.) forming a plurality of wall modules;

c.) forming a plurality of window panel modules;

d.) forming a plurality of door panel modules;

e.) and providing a plurality of fasteners;

f.) forming each of the wall, window panel, and door panel modules by interconnecting offset horizontal planks, vertical planks that define an outer perimeter of each of the module, and interstitial planks connected between the vertical planks that are used to increase the strength of each of the module, together in any one of a plurality of configurations to form each respective module in a pre-chosen dimension and configuration;

g.) and interconnecting the modules to one another in any of a number of configurations using the fasteners to form a chosen modular house configuration;

h.) and providing and connecting a plurality of floor panels to each of the floor support module, to thereby cover each of the floor support surface and forming floor surfaces thereon.

The modular house building system has floor panel modules consisting in a triad of open trusses that are parallel and kept at a relative distance by way of holding members and each floor panel module has two opposite ends which are made of flat pieces of wood having notches configured and sized to allow the passage of overlapping planks.

The modular house building system has a plurality of floor support modules along the top edges of the wall, window panel, and door panel modules to thereby form a second level floor support; in following a plurality of floor panel modules are then placed upon the second level floor support and connected to one another forming a secure horizontal second floor and thereby enclosing the rectangular module.

The modular house building system wherein a series of wall, window panel, and door panel modules are secured vertically along at least two outer edges of the second floor, and along any other chosen horizontal direction along the second floor, and adjacent to one another forming a second floor rectangular module.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

BRIEF DESCRIPTION OF THE DRAWINGS

FIGS. 5*a-c* Isometric views of door panel sizes.

DETAILED DESCRIPTION OF THE PREFERRED EMBODIMENT

Figure 1:
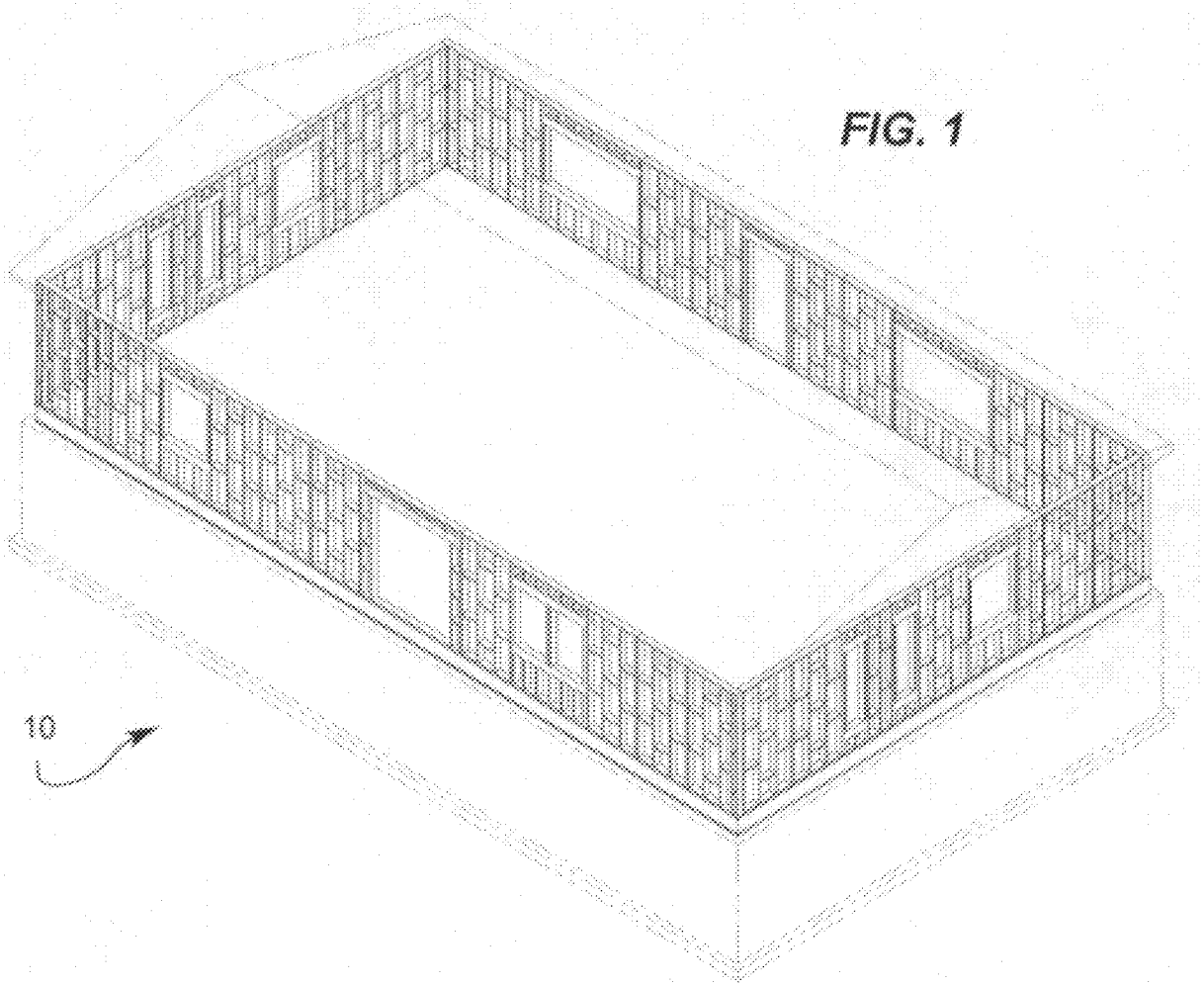
FIG. 1 Isometric view of the invention.
Figures 2A, 2B, 2C, 2D:
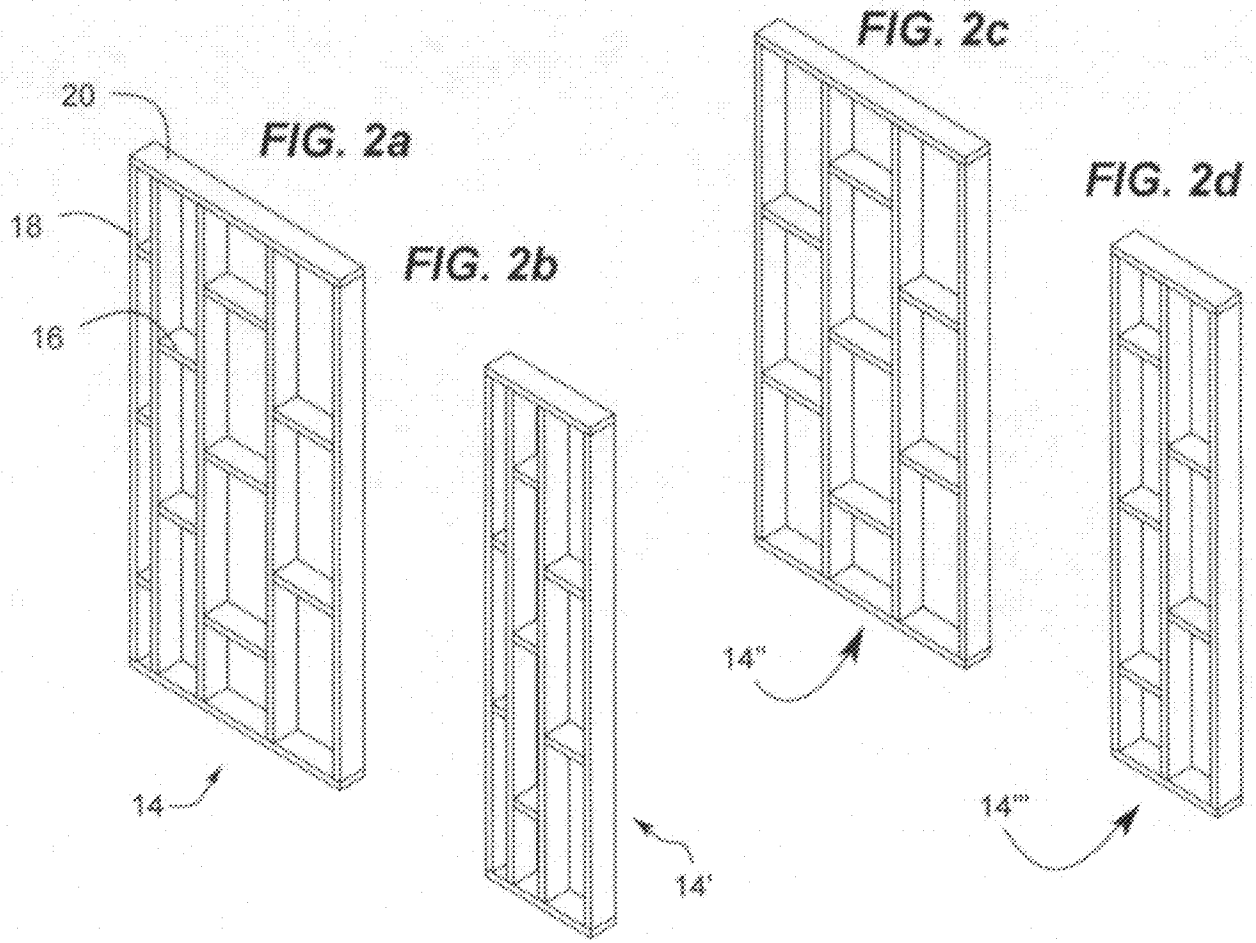
FIGS. 2*a-d* Isometric view of wall modules.

A modular house building system (10) is comprised of a wide variety of pre-constructed, pre-assembled wall and floor modules so that a house of any size and shape can be constructed.

For example, FIGS. 2*a-d* show wall modules (14, 14', 14" 14'") that have different width and as such, can give a precision down to a single foot in the length one desires for a wall section.

All modules, except for floor support modules (28) have the same elements in common. That is horizontal planks (16) and vertical planks (18) that define the outer perimeter of the module. A third element are the interstitial planks (20) that ensure strong structural integrity to the modules.

Figures 3A, 3B, 3C, 3D, 3E, 3F:
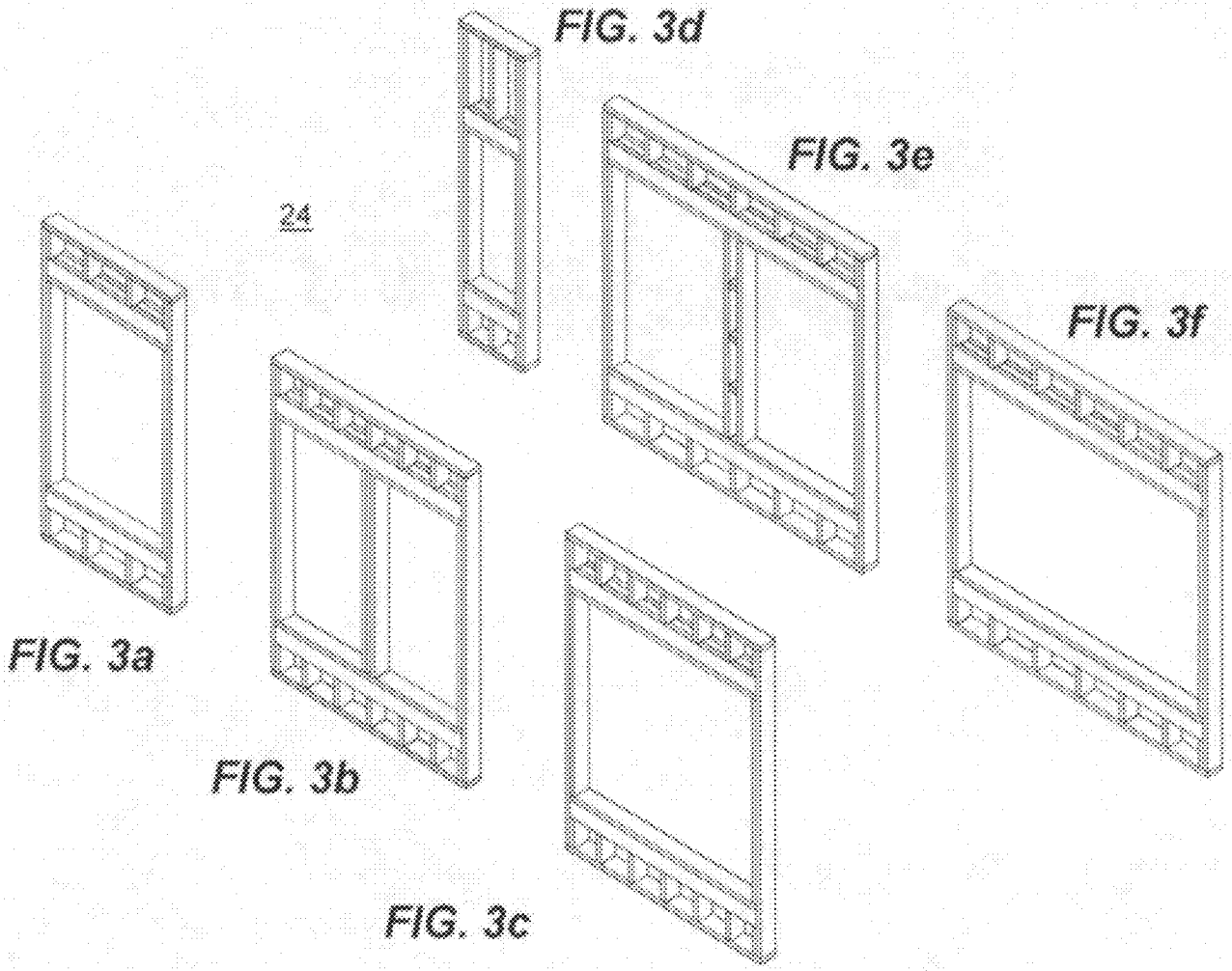
FIGS. 3*a-f* Isometric views of window panel sizes.
Figures 4A, 4B, 4C, 4D, 4E, 4F:
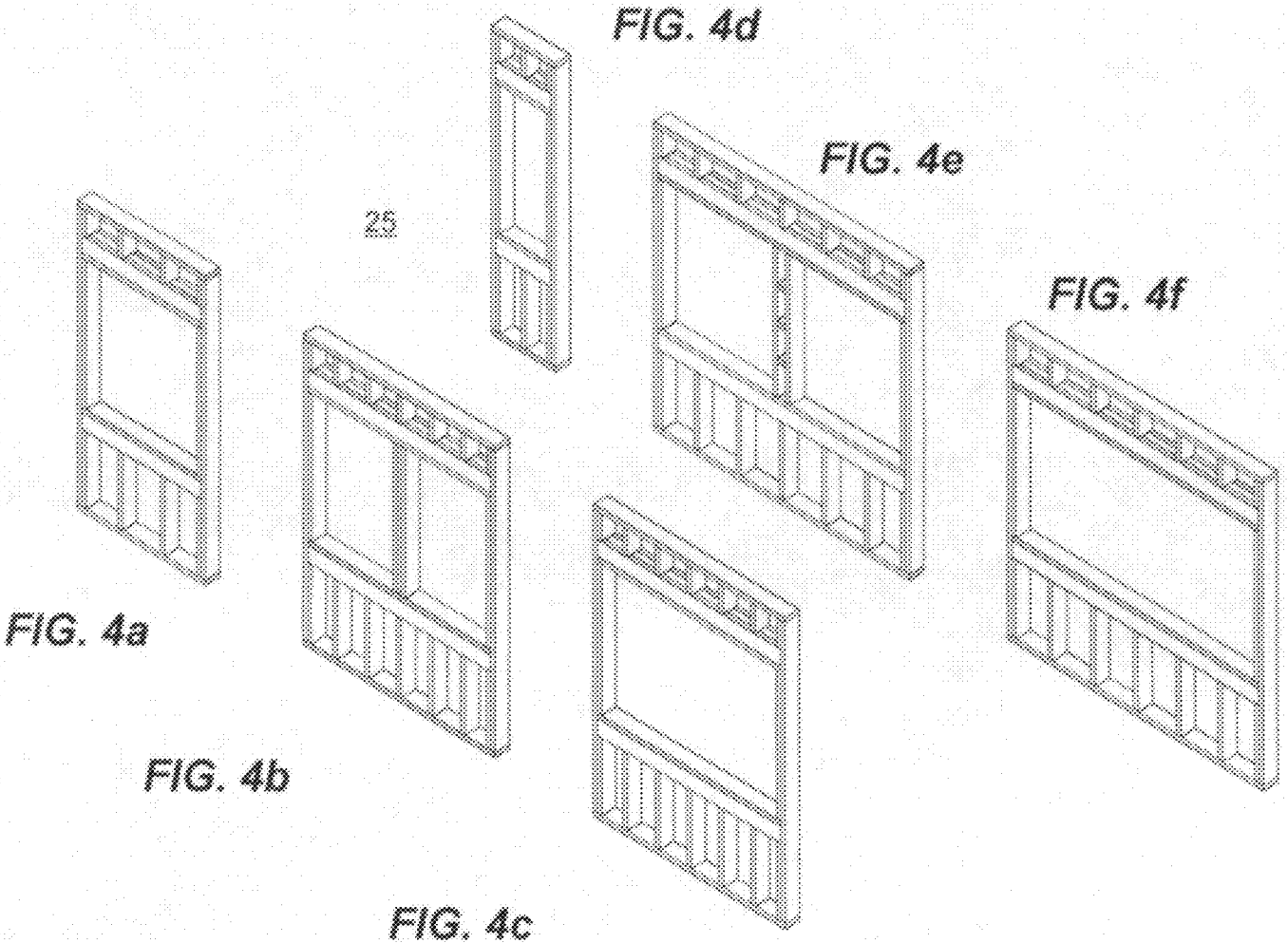
FIGS. 4*a-f* Isometric views of variants of window panel sizes.

FIGS. 3-4 show variants of window panel modules (24, 25) to cover all needs. FIG. 5 show variants of door panel modules (26).

Figures 6A, 6B, 6C:
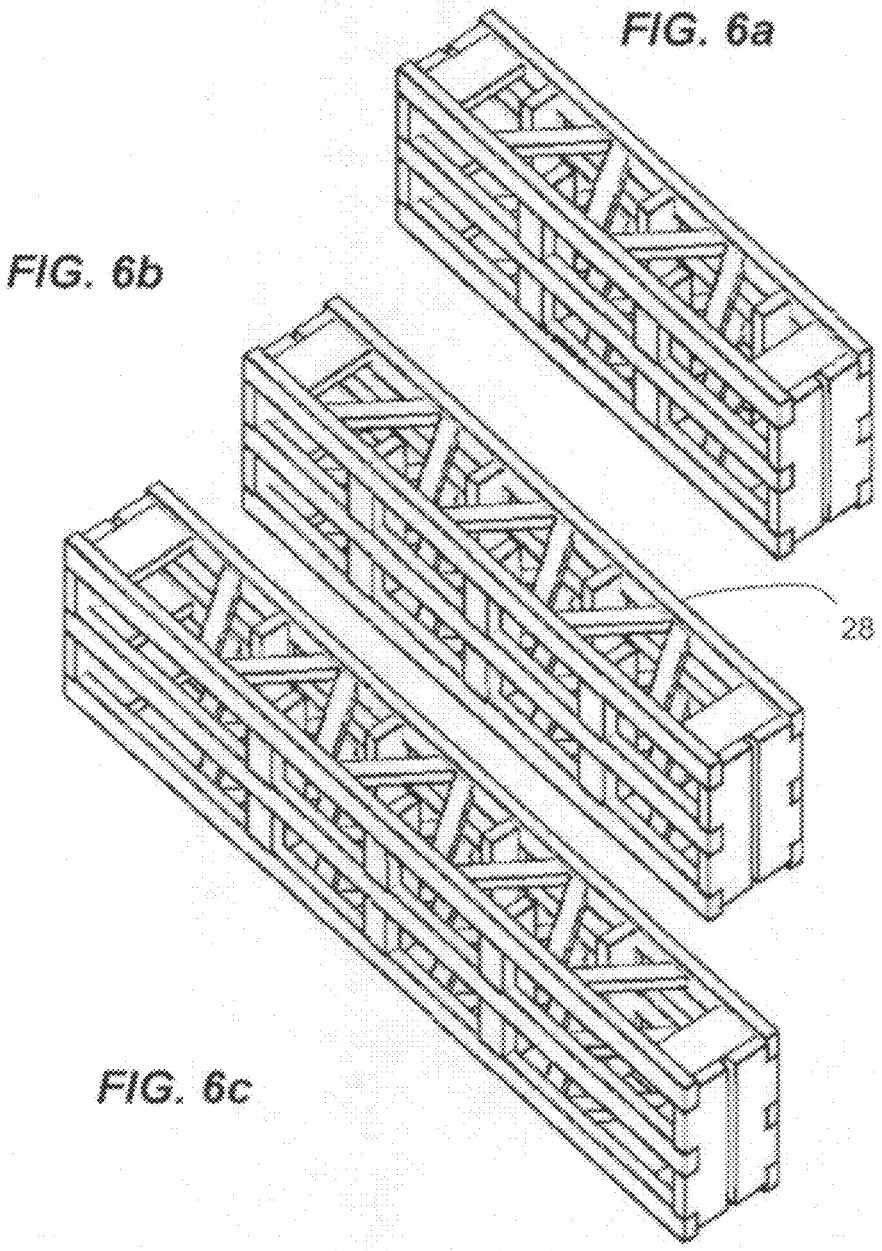
FIGS. 6*a-c* Isometric views of various lengths of the open truss floor support modules.

FIG. 6 shows the open truss structure of the floor support modules (28) which can also be used for roof support.

Figure 7:
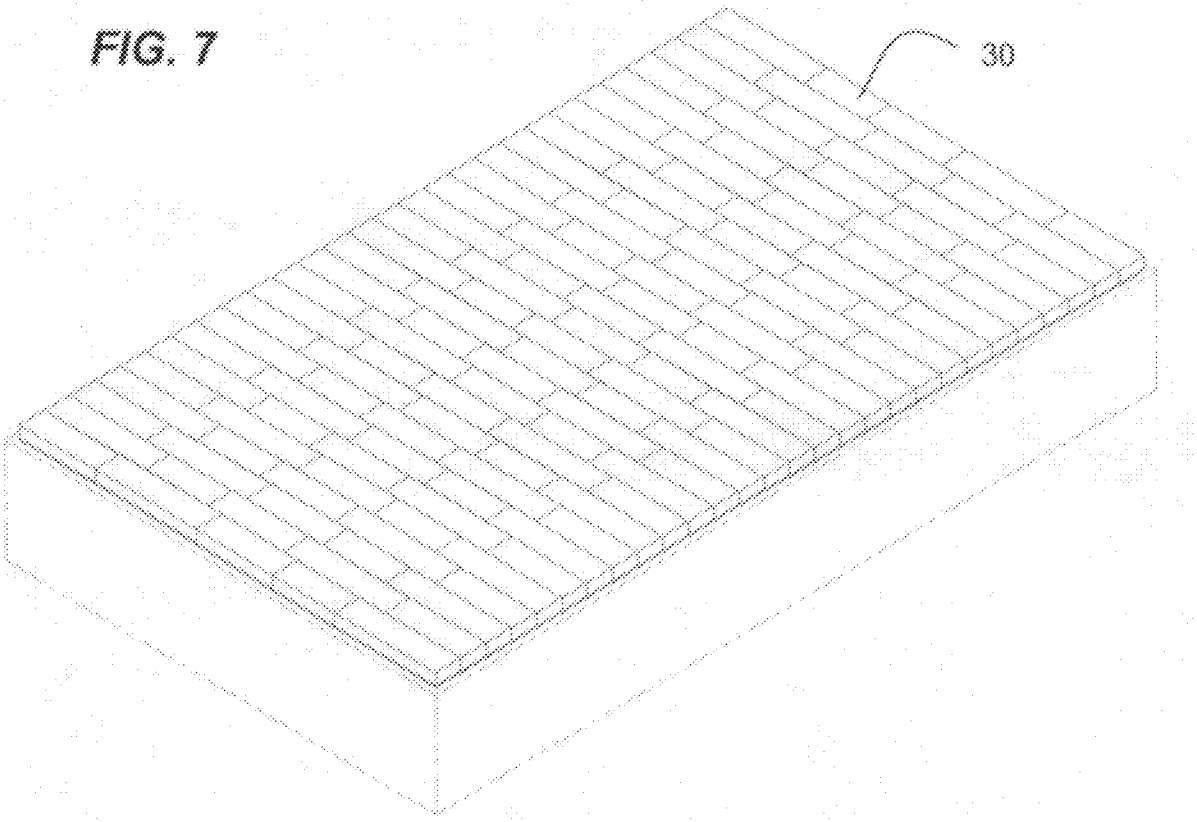
FIG. 7 Isometric view of a plurality of connected floor panels laid over a plurality of connected floor support modules.
Figure 8:
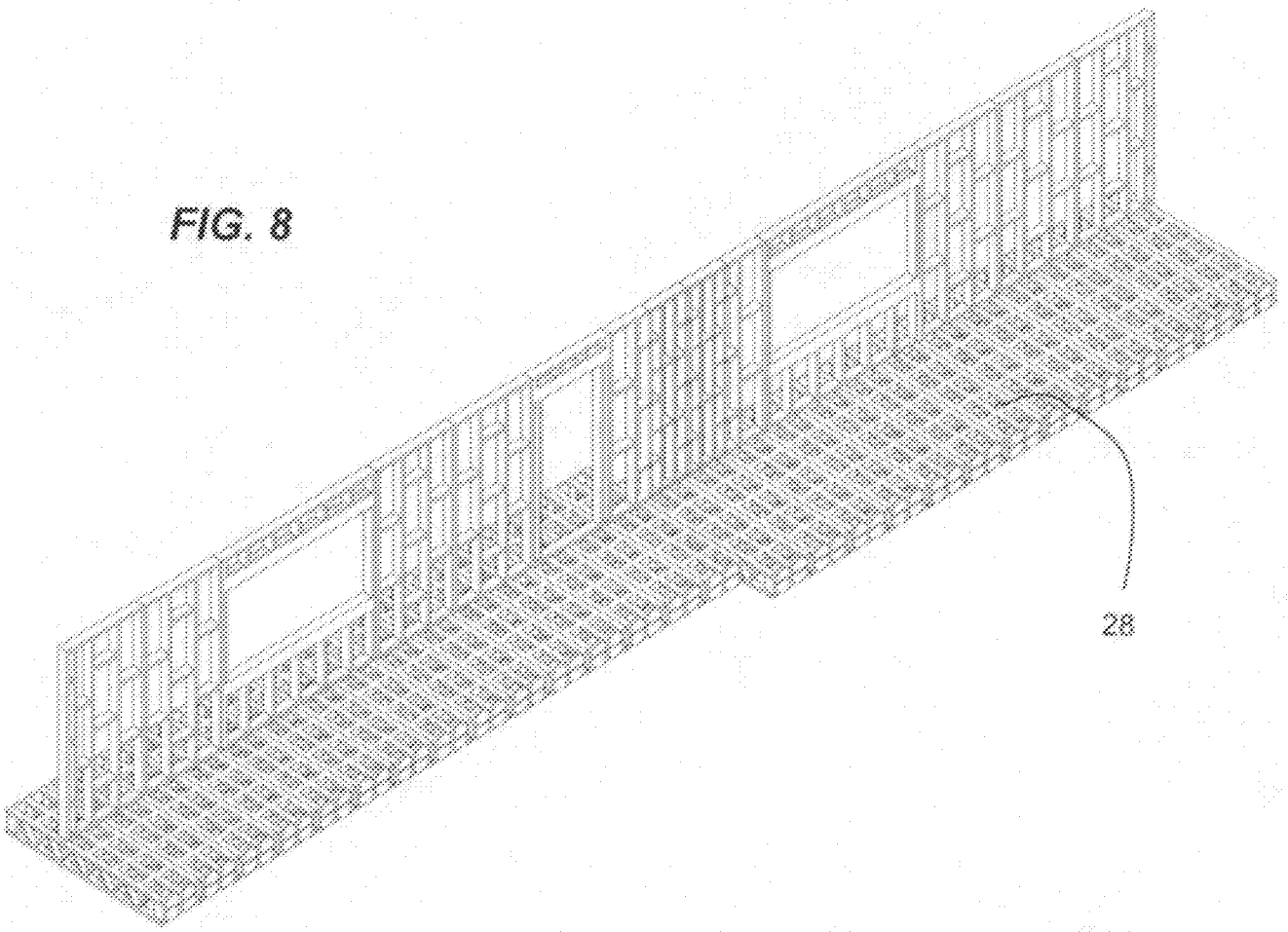
FIG. 8 Isometric view of a floor and wall.
Figure 9:
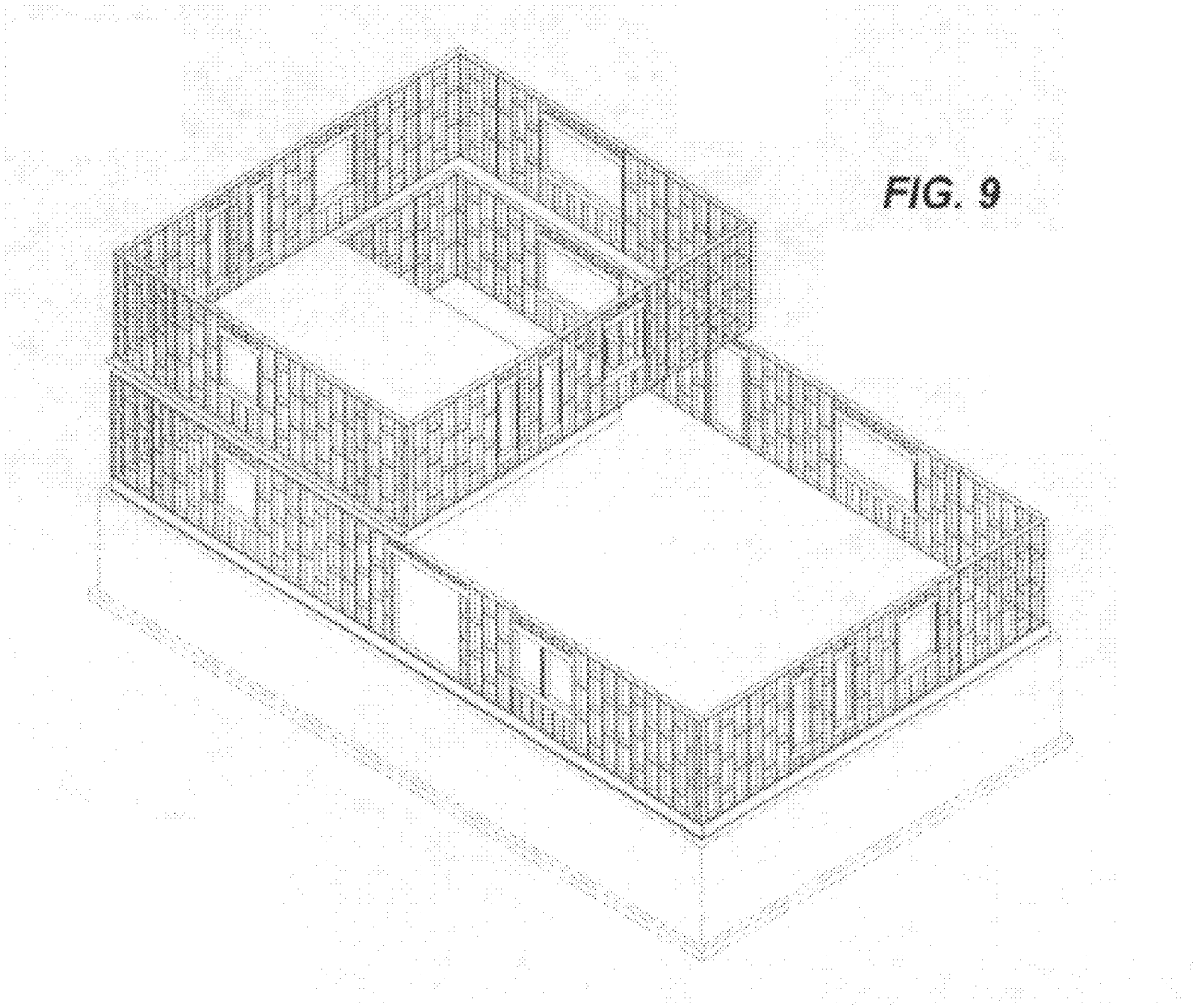
FIG. 9 Isometric view of a two floor house.

FIG. 7 Shows a plurality of connected floor panel (30) laid over a plurality of connected floor support modules (28).

Figure 10:
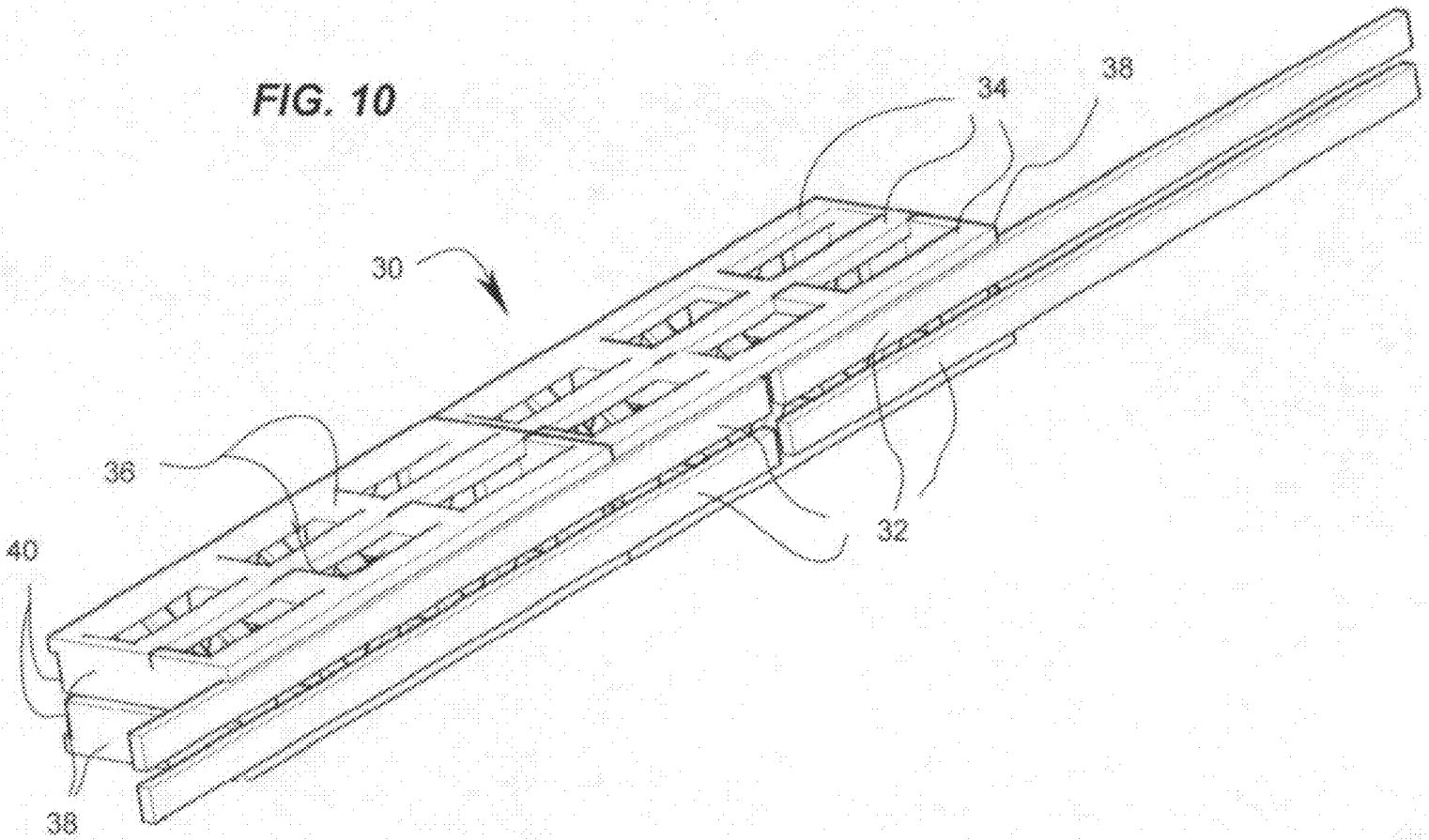
FIG. 10 Is an isometric view of a pair of floor support modules.

FIG. 10 shows how the floor panel (30) are connected together by way of overlapping planks (32) which linearly overlap two floor panel (30) so as to bridge them together.

The floor panel module (30) consists in a triad of open trusses (34) that are parallel and kept at a relative distance by way of holding members (36). Each floor panel (30) has two opposite ends (38) which are made of flat pieces of wood having notches (40) configured and sized to allow the passage of the overlapping planks (32).

The modules are mechanically fastened together using common mechanical fasteners such as nails, bolts, screws and can also use adhesives. The modules can be used for building ships and any of a variety of constructions. Because each module is factory assembled, better quality control can be had. The factory assembly method follows the building code.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A method of building a modular house comprising the steps of:

a.) forming a plurality of floor support modules each consisting of a triad of open trusses that are equal in length and, parallel to one another, and kept at a relative distance from one another by way of holding members connected therebetween at predetermined separated intervals, and wherein each said floor support module having two opposite ends formed from flat pieces of wood having notches formed therein allowing for the passage of overlapping planks; and a plurality of overlapping planks each fit within respective notches of adjacent floor support modules, such that a plurality of floor support modules are connected end-to-end via said overlapping planks to form a desired length of floor support modules, and then said floor support modules are placed side-by-side to form a floor support surface of desired dimensions for supporting said floor panels thereon;

b.) forming a plurality of wall modules;

c.) forming a plurality of window panel modules;

d.) forming a plurality of door panel modules;

e.) and providing a plurality of fasteners;

f.) forming each of said wall, window panel, and door panel modules by interconnecting offset horizontal planks, vertical planks that define an outer perimeter of each said module, and interstitial planks connected between said vertical planks that are used to increase the strength of each said module, together in any one of a plurality of configurations to form each respective module in a prechosen dimension and configuration;

g.) and interconnecting said modules to one another in any of a number of configurations using said fasteners to form a chosen modular house configuration;

h.) and providing and connecting a plurality of floor panels to each said floor support module, to thereby cover each said floor support surface and forming floor surfaces thereon.

2. The modular house building method of claim 1, wherein said fasteners are mechanical fasteners and are chosen from a group of mechanical fasteners consisting of nails, bolts, and screws.

3. The modular house building method of claim 1, wherein said fasteners are formed from an adhesive material.

4. The modular house building method of claim 3, wherein a plurality of floor support modules are incorporated along the top edges of said wall, window panel, and door panel modules to thereby form a second level floor support surface; in following a plurality of floor panels are then placed upon said second level floor support surface and connected thereto forming a secure horizontal second floor and thereby enclosing said rectangular module.

5. The modular house building method of claim 4, wherein a series of wall, window panel, and door panel modules are secured vertically along at least two outer edges of said second floor, and along any other chosen horizontal direction along said second floor, and adjacent to one another forming a second floor rectangular module.

6. The modular house building method of claim 5, wherein the system follows securing a plurality of floor support modules along the top edges of said wall, window panel, and door panel modules to thereby form a third level floor support surface; in following a plurality of floor panels are then placed upon said third level floor support surface and connected thereto forming a secure horizontal third floor and thereby enclosing said second floor rectangular module.

7. The modular house building method of claim 3, comprising the steps of:

a) incorporating a plurality of floor support modules along top edges of said wall, window panel, and door panel modules to thereby form an upper level floor support surface; then placing and connecting a plurality of floor panels upon said upper level floor support surface, thereby forming a secure horizontal upper level floor and enclosing said module;

b) securing a series of wall, window panel, and door panel modules vertically along at least two outer edges of said upper level floor, and along any other chosen horizontal direction along said upper level floor, and adjacent to one another forming an upper floor rectangular module; and c) repeating steps a) and b) until a pre-chosen modular house has been completed.

8. A modular house building system comprising a plurality of floor support modules; floor panels; wall modules; window panel modules; door panel modules; and fasteners, wherein said modules are connected to one another in any of a number of configurations using said fasteners to form a chosen modular house configuration; wherein said wall, window panel, and door panel modules each include offset horizontal planks, vertical planks that define an outer perimeter of each said module, and interstitial planks connected between said vertical planks that are used to increase the strength of each said module, and are connected together in any one of a plurality of configurations to form each respective module in a pre-chosen dimension and configuration; and wherein each said floor support modules includes a triad of open trusses that are equal in length and, parallel to one another, and kept at a relative distance from one another by way of holding members connected therebetween at predetermined separated intervals, and wherein each said floor support module having two opposite ends formed from flat pieces of wood having notches formed therein allowing for the passage of overlapping planks; and a plurality of overlapping planks each fit within respective notches of adjacent floor support modules, such that a plurality of floor support modules are connected end-to-end via said overlapping planks to form a desired length of floor support modules, and then said floor support modules—are placed side-by-side to form a floor support surface of desired dimensions for supporting said floor panels thereon.

9. The modular house building system of claim 8, wherein said fasteners are mechanical fasteners and are chosen from a group of mechanical fasteners consisting of nails, bolts, and screws.

10. The modular house building system of claim 8, wherein said fasteners are formed from an adhesive material.

* * * * *